US006812684B1

(12) United States Patent
Leifhelm et al.

(10) Patent No.: US 6,812,684 B1
(45) Date of Patent: Nov. 2, 2004

(54) BANDGAP REFERENCE CIRCUIT AND METHOD FOR ADJUSTING

(75) Inventors: Martin Leifhelm, Villach (AT); Markus Müllauer, Friesach (AT)

(73) Assignee: Infineon Technologies AG, Munich (DE)

( * ) Notice: Subject to any disclaimer, the term of this patent is extended or adjusted under 35 U.S.C. 154(b) by 68 days.

(21) Appl. No.: 10/444,861

(22) Filed: May 22, 2003

Related U.S. Application Data

(63) Continuation of application No. PCT/DE01/04230, filed on Nov. 8, 2001.

(30) Foreign Application Priority Data

Nov. 22, 2000 (DE) ..... 100 57 844

(51) Int. Cl.[7] ..... G05F 3/04
(52) U.S. Cl. ..... 323/312; 323/316
(58) Field of Search ..... 323/312, 313, 323/314, 316, 907

(56) References Cited

U.S. PATENT DOCUMENTS 5,325,045 A 6/1994 Sundby
5,352,973 A 10/1994 Audy
6,014,020 A 1/2000 Kuttner
6,118,264 A 9/2000 Capici
6,198,266 B1 * 3/2001 Mercer ..... 323/316
6,201,379 B1 * 3/2001 MacQuigg et al. ..... 323/313

FOREIGN PATENT DOCUMENTS

DE 69028110 T2 1/1997
EP 0 476 052 B1 3/1992

* cited by examiner

*Primary Examiner*—Adolf Berhane
(74) *Attorney, Agent, or Firm*—Laurence A. Greenberg; Werner H. Stemer; Gregory L. Mayback

(57) ABSTRACT

The invention relates to a method for adjusting a BGR circuit. In a first adjustment step, an offset adjustment of a voltage differential amplifier is performed at a predetermined temperature. In a second adjustment step, the reference voltage generated by the BGR circuit is regulated to as predetermined value of the reference voltage at the predetermined temperature by setting a variable resistance of an external circuitry of the voltage differential amplifier.

14 Claims, 3 Drawing Sheets

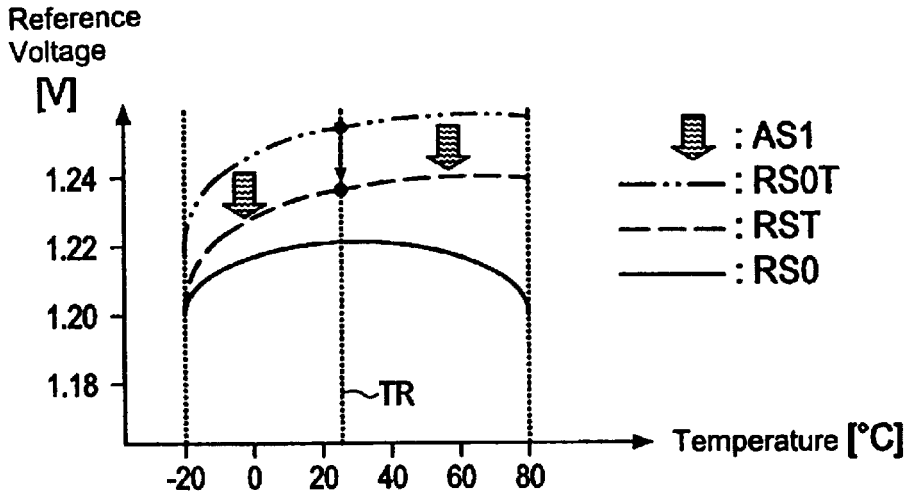
FIG. 2
FIG. 3
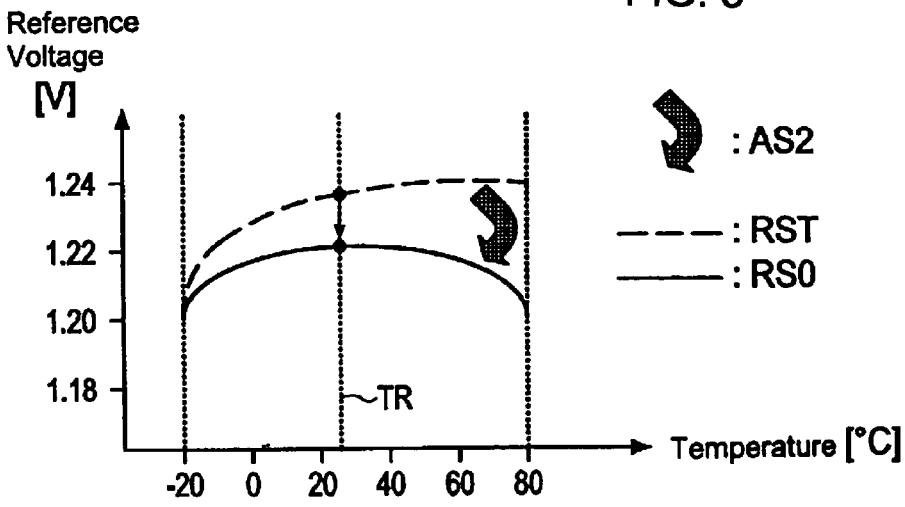

BANDGAP REFERENCE CIRCUIT AND METHOD FOR ADJUSTING

CROSS REFERENCE TO RELATED APPLICATION

This application is a continuation of copending International Application No. PCT/DE01/04230, filed Nov. 8, 2001, which designated the United States and was not published in English.

BACKGROUND OF THE INVENTION

Field of the Invention

The invention relates to a method for adjusting a BGR (Bandgap Reference) circuit and to a BGR circuit that can be adjusted using the method.

Circuits that generate a constant output voltage that is independent of temperature and supply voltage fluctuations are required for various applications in semiconductor circuit technology. They are used in both analog, digital and hybrid analog/digital circuits. One type of such circuits often used are known as BGR circuits (bandgap reference circuits).

The basic principle of a BGR circuit consists in adding two partial signals (voltages or currents) which have a mutually opposite temperature response. While one of the two partial signals falls as the temperature increases, the other partial signal rises as the temperature increases. The output voltage that is constant with temperature over a certain range is then derived from the sum of the two partial signals. The output voltage of a BGR circuit is also referred to as a reference voltage hereinafter in accordance with the customary usage.

A known problem in the case of BGR circuits is that circuits from the same production series have different reference voltages. In practice, it is often necessary, therefore, to adjust the BGR circuit in order to obtain a sufficient accuracy with regard to the desired absolute reference voltage value and/or the desired temperature constancy of the reference voltage.

BGR circuits have both passive components, e.g. resistors, and active components, usually in the form of a differential or operational amplifier. A deviation of the reference voltage from the ideal, calculated value and from a constant temperature response is attributed to a lack of matching of the passive and active components.

The aim of adjusting a BGR circuit consists, on the one hand, in minimizing a deviation of the reference voltage value obtained at a specific temperature from a value calculated with respect to this temperature and, on the other hand, in optimizing the temperature characteristic of the reference voltage, i.e. in obtaining a flat voltage/temperature characteristic curve.

The following methods have been disclosed heretofore for adjusting BGR circuits:

In a first known method, an offset compensation is performed directly at the amplifier that generates the offset. Most operational amplifiers have suitable actuating inputs for this purpose. An offset compensation eliminates the predominant error component of the deviation between the reference voltage value obtained at the output of the circuit and the calculated value. What is disadvantageous, however, is that a residual deviation of the aforementioned parameters generally remains and that an optimum temperature characteristic of the reference voltage is not obtained, rather, on the contrary, it is often the case that the temperature characteristic is even impaired by this step.

In a second known method, the output voltage of the circuit (i.e. the reference voltage) is set directly to the calculated value by a regulable resistor or another passive component of the circuit. In this way, the correct voltage value is obtained at the temperature at which the setting is effected. What is disadvantageous is that an optimum temperature constancy of the reference voltage cannot be guaranteed in the case of this method.

BGR circuits that have to meet very stringent requirements with regard to the absolute value and the temperature constancy of the reference voltage have to be optimized both with regard to their absolute value (which is predominated by the offset error) and with regard to their temperature response. Such BGR circuits have to be adjusted at two different temperatures. The high complexity required for this is disadvantageous.

U.S Pat. No. 6,118,264 describes a BGR circuit that is connected to an adjustment device. The adjustment device generates a compensation voltage that is added to the BGR voltage provided by the BGR circuit, as a result of which a reference voltage is generated. The compensation voltage has an opposite temperature characteristic to the BGR voltage over specific temperature ranges. Overall, this results in an improved temperature characteristic of the reference voltage.

SUMMARY OF THE INVENTION

It is accordingly an object of the invention to provide a circuit for generating a temperature-stabilized reference voltage and a method for adjusting the circuit to provide a predetermined value of the reference voltage, which overcomes the above-mentioned disadvantages of the prior art apparatus and methods of this general type.

The adjustment method for BGR circuits is simple to carry out and makes it possible to achieve a good temperature constancy of the reference voltage and a good correspondence between the reference voltage value and an expected or calculated voltage value. Furthermore, the invention provides a BGR circuit that can be adjusted in a simple manner With the foregoing and other objects in view there is provided, in accordance with the invention, a method for adjusting a circuit for generating a temperature-stabilized reference voltage to generate a predetermined value of the reference voltage. The method includes steps of: constructing the circuit from a voltage differential amplifier and an external circuitry including at least one component with a variable resistance, the external circuitry assigned to the voltage differential amplifier; performing an offset adjustment of the voltage differential amplifier at a predetermined temperature; and subsequently adjusting the reference voltage to the predetermined value of the reference voltage at the predetermined temperature by setting the variable resistance of the component.

With the foregoing and other objects in view there is also provided, in accordance with the invention, a circuit for generating a temperature-stabilized reference voltage. The circuit includes: a voltage differential amplifier having an inverting input, a noninverting input, and an output; a device for offset correction assigned to the voltage differential amplifier; and an external circuitry configured external to the voltage differential amplifier. The external circuitry is connected to the inverting input, the noninverting input, and the output of the voltage differential amplifier. The external circuitry is constructed such that the output voltage of the voltage differential amplifier corresponds to a sum of at least two signals each having a temperature characteristic. The temperature characteristic of one of the two signals has a sign that is different than the temperature characteristic of another one of the two signals. The external circuitry includes at least one component having a variable resistance for influencing the temperature characteristic of at least one of the two signals. The external circuitry includes a first switching device for isolating the inverting input and the noninverting input of the voltage differential amplifier from the external circuitry. The external circuitry includes a second switching device for short-circuiting the inverting input and the noninverting input of the voltage differential amplifier.

The adjustment method includes two adjustment steps that are carried out one after the other: in a first adjustment step, an offset adjustment of the voltage differential amplifier is carried out at a predetermined temperature. In a second adjustment step, the value of the reference voltage obtained during the first adjustment step is then set to the predetermined (i.e. calculated) value of the reference voltage for this circuit.

The particular advantage of the method is that the two adjustment steps are carried out at one and the same temperature and in this case, an adjustment is brought about with regard both to the absolute value and to the temperature characteristic of the reference voltage obtained.

The term "voltage differential amplifier" means any type of an amplifier that is designed to amplify a voltage difference. In particular, the term encompasses a differential amplifier and an operational amplifier.

An advantageous procedure when carrying out the first adjustment step is characterized in that this step includes the substeps of short-circuiting the inputs of the voltage differential amplifier and regulating the output voltage of the voltage differential amplifier to a predetermined voltage value. The predetermined voltage value may be, in particular, the common mode voltage, which is the mean of the positive and negative potentials of the operating voltage of the voltage differential amplifier. The voltage differential amplifier is preferably operated as a comparator during the offset adjustment.

In accordance with an additional feature of the invention, the inputs of the voltage differential amplifier can be isolated from the external circuitry by a first switching device and can be short-circuited by a second switching device. In this configuration of the circuit, the short-circuit adjustment of the voltage differential amplifier can then be performed for the purpose of offset correction. Afterward, the inputs of the voltage differential amplifier can be connected to the external circuitry again by the first switching device and the short circuit of the inputs can be cancelled by the second switching device. In this configuration of the circuit, the adjustment of the output voltage of the circuit to the predetermined value of the reference voltage can then be carried out by varying the resistance of at least one component having an adjustable resistance. This adjustment has the effect that a virtually constant, i.e. temperature-independent, reference voltage is established in a certain range around the predetermined temperature.

The advantages of this BGR circuit are that the same circuit can be used both to compensate for the voltage offset of the voltage differential amplifier and to carry out the adjustment of the passive components of the circuit.

Other features which are considered as characteristic for the invention are set forth in the appended claims.

Although the invention is illustrated and described herein as embodied in a method for adjusting a BGR circuit and BGR circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a graph of the reference voltage plotted against the temperature for elucidating the inventive offset error compensation;

FIG. 3 is a graph of the reference voltage plotted against the temperature for elucidating the inventive temperature characteristic error compensation.

DESCRIPTION OF THE PREFERRED EMBODIMENTS

Figure 1A:
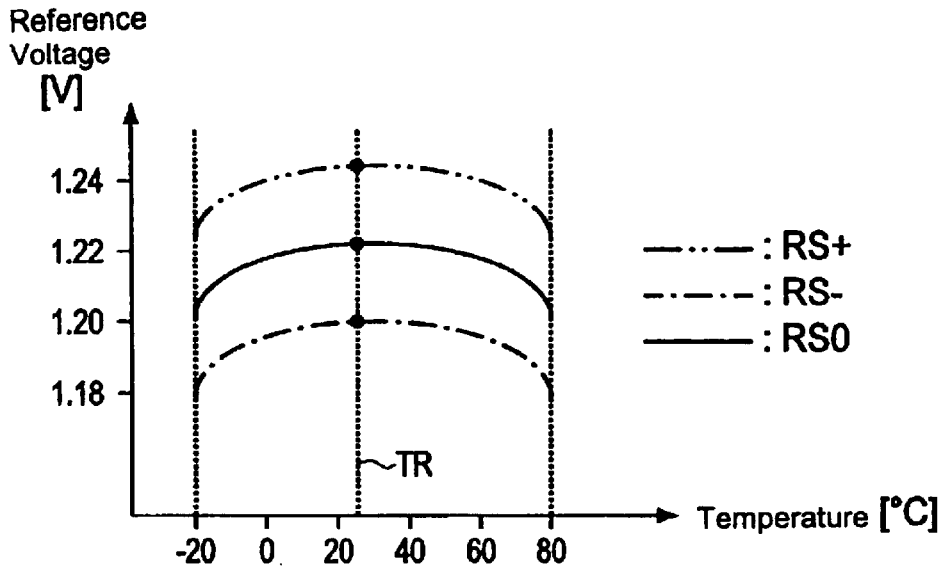
FIG. 1A is a graph of the reference voltage plotted against the temperature for elucidating the offset error.
Figure 1B:
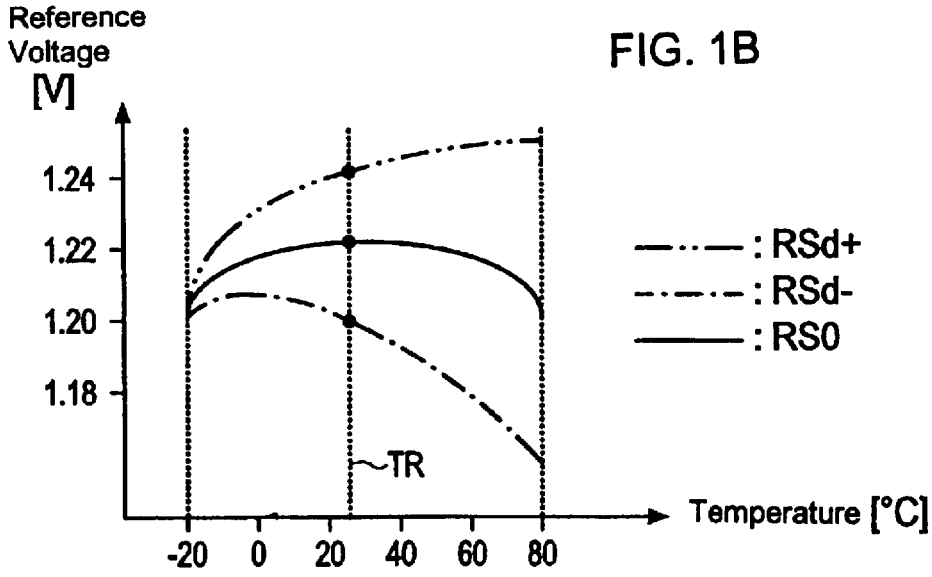
FIG. 1B is a graph of the reference voltage plotted against the temperature for elucidating the temperature characteristic error.

Referring now to the figures of the drawing in detail and first, particularly, to FIGS. 1A and 1B thereof, there is shown the two essential effects which are responsible for the occurrence of deviations between the reference voltage obtained and the calculated reference voltage.

FIG. 1A, which plots the reference voltage on the Y-axis, shows the case where the reference voltage output by a non-adjusted BGR circuit has a profile either higher (reference voltage curve RS+) or lower (reference voltage curve RS−) than the calculated ideal reference voltage curve RS0 over the entire temperature range considered (X-axis), but has an optimally flat profile with regard to its temperature response and an optimally symmetrical profile with regard to the room or use temperature TR. This effect is principally caused by an offset in the voltage differential amplifier. It is referred to as the offset error hereinafter and is generally the predominant error component in non-adjusted BGR circuits.

FIG. 1B shows the case where the reference voltage has either a characteristic that rises as the temperature increases (reference voltage curve RSd+), or a characteristic that falls as the temperature increases (reference voltage curve RSd−). This effect is principally based on a lack of matching of the passive components of the BGR circuit. It is also referred to as temperature characteristic error hereinafter.

The two errors explained with reference to FIGS. 1A and 1B occur jointly in a non-adjusted BGR circuit.

FIGS. 2 and 3 illustrate the two adjustment steps of the inventive method, which has the goal of eliminating the errors explained.

FIG. 2 illustrates the first adjustment step AS1. The reference voltage curve RSOT is affected both by an offset error and by a temperature characteristic error. An offset adjustment of the voltage differential amplifier at the room or use temperature TR eliminates the offset error, so that the reference voltage curve RSOT is shifted parallel to the X-axis in the direction of the calculated ideal reference voltage curve RS0. However, the optimum temperature characteristic is not produced during this step (i.e. the reference voltage curve RST generated as a result still differs in terms of its temperature characteristic from the calculated ideal reference voltage curve RS0), since the errors of the passive components of the BGR circuit are not compensated for.

FIG. 3 illustrates the second adjustment step AS2. In this case, the temperature characteristic error of the reference voltage curve RST is eliminated by carrying out an adjustment of the reference voltage to the predetermined value of the reference voltage at the room or use temperature TR. As a result, the temperature characteristic of the reference voltage curve RST is matched to the calculated ideal reference voltage curve RS0, so that both reference voltage curves subsequently have the same profile.

Figure 4:
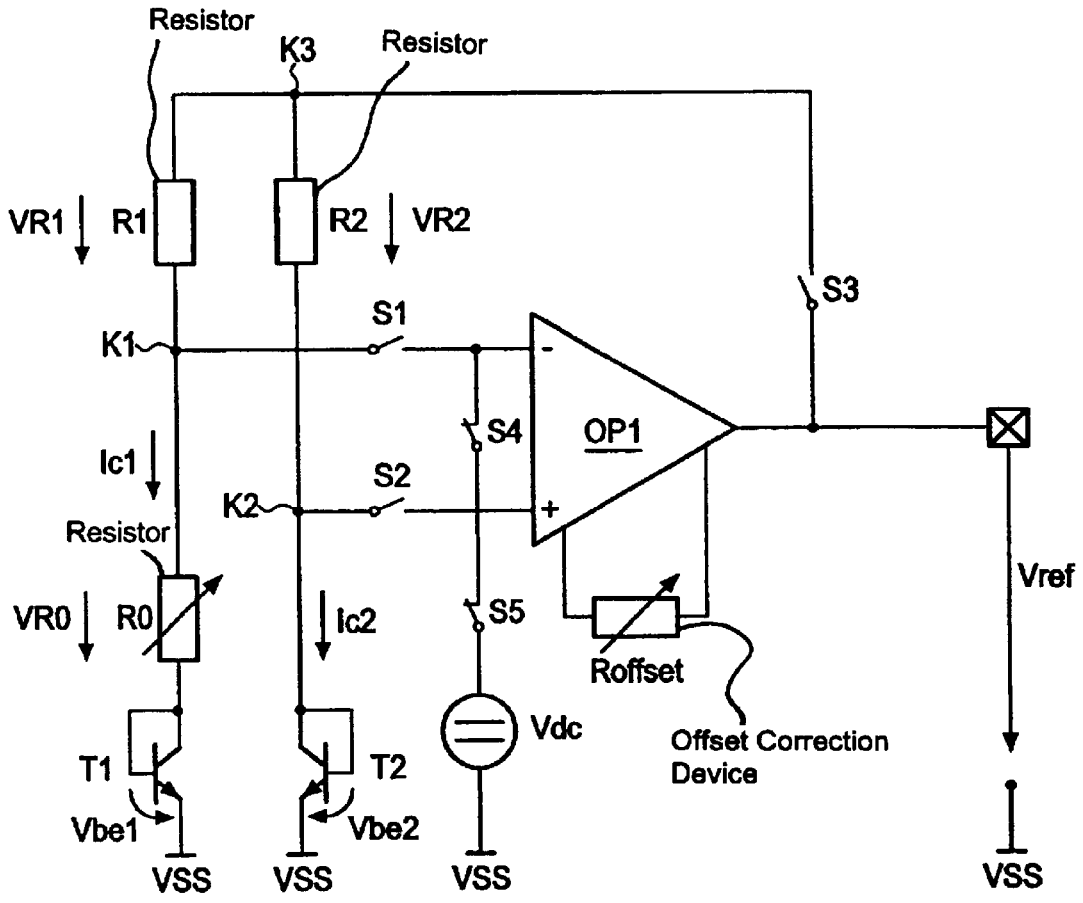
FIG. 4 is a circuit diagram of the inventive BGR circuit.

FIG. 4 shows an inventive BGR circuit, which is suitable and designed for carrying out the inventive method. The inverting input of an operational amplifier OPI is connected via a switch S1 to a node K1 of a first circuit branch of an external circuitry of the operational amplifier OP1. The noninverting input of the operational amplifier OP1 is connected via a switch S2 to a node K2 of a second circuit branch of the external circuitry of the operational amplifier OP1. The two circuit branches in each case extend from a common fixed potential, in particular a ground VSS, to a common node K3, from where they are connected via a switch S3 to the output of the operational amplifier OP1.

The first circuit branch has a resistor R1 between the node K1 and the common node K3. In the second circuit branch, a resistor R2 is situated between the nodes K2 and K3. Furthermore, the node K1 is connected via an adjustable resistor R0 to the collector terminal of a bipolar transistor T1 of the first circuit branch. The base terminal of the bipolar transistor T1 is likewise connected to its collector terminal, while the emitter terminal is connected to the ground VSS. The node K2 is connected to the collector and base terminals of a bipolar transistor T2 of the second circuit branch. The emitter terminal of the bipolar transistor T2 is again connected to the ground VSS.

The inverting and noninverting inputs of the operational amplifier OP1 can be short-circuited via a switch S4. The constant voltage source Vdc illustrated in FIG. 4 represents the common mode voltage given by the mean of the operating voltage potentials. A reference voltage Vref can be tapped off at the output of the operational amplifier OP1. An adjustable resistor Roffset is present at the terminals of the operational amplifier OP1 for the purpose of offset adjustment.

For the offset adjustment of the operational amplifier OP1, the switches S4 and S5 are in the closed switching position and the switches S1, S2 and S3 are open. As a result, the external circuitry is disconnected from the operational amplifier OP1. In this configuration of the circuit, the operational amplifier OP1 is operated as a comparator. The operational amplifier OP1 is adjusted by setting the adjustable resistor Roffset. The optimum offset adjustment is characterized by the changeover point of the comparator. This corresponds to the common mode voltage, i.e. is 0 V, for example, in the case of symmetrical operating voltage potentials or has a value of 1.2 V, for example, in the case of operating voltage potentials of e.g. 0 V and 2.4 V. The adjustment is effected at a predetermined room or use temperature TR. On account of this offset adjustment, during the later operation of the BGR circuit, the reference voltage Vref has no offset error caused by the operational amplifier OP1.

After the offset adjustment of the operational amplifier OP1 has been effected, the switches S4 and S5 are opened and the switches S1, S2 and S3 are closed. In this switch position, the adjustable resistor R0 can be set at the predetermined room or use temperature TR in such a way that the reference, voltage Vref assumes the value of a predetermined reference voltage. This measure eliminates the temperature characteristic error, so that the reference voltage Vref has a constant profile over a certain temperature range around the room or use temperature TR.

The method of operation of the BGR circuit illustrated in FIG. 4 is explained below.

The following currents and voltages occur in the circuit diagram:

Ic1: collector current of the bipolar transistor T1
Ic2: collector current of the bipolar transistor T2
Vbe1: base-emitter voltage of the bipolar transistor T1
Vbe2: base-emitter voltage of the bipolar transistor T2
VR0: voltage dropped across the adjustable resistor R0
VR1: voltage dropped across the resistor R1
VR2: voltage dropped across the resistor R2

The voltage Vref present at the output of the operational amplifier OP1 can be expressed by the voltage VR2 dropped across the resistor R2 and the base-emitter voltage Vbe2 of the bipolar transistor T2:

$$Vref=VR2+Vbe2 \quad (1)$$

The voltage dropped across a bipolar transistor between base and emitter has a temperature dependence. By way of example, the temperature coefficient of the base-emitter voltage at a temperature of 300 K and an applied voltage of 0.6 V is about −2 mV/K. In order to obtain a temperature-stabilized reference voltage Vref, a voltage with an identical temperature coefficient in terms of magnitude, but an opposite sign, must be added to the base-emitter voltage. This means that the voltage VR2 dropped across the resistor R2, at a temperature of 300 K, must have a temperature coefficient of +2 mV/K. This temperature-dependent voltage is generated using the bipolar transistor T1.

In order to make this apparent, it is additionally necessary to establish various mesh equations of the BGR circuit illustrated in FIG. 4. The following furthermore holds true:

$$Vref=VR1+Vbe2 \quad (2)$$

$$VR0=Vbe2-Vbe1 \quad (3)$$

In order to establish equation (3) for the voltage VR0 dropped across the adjustable resistor R0, it must be taken into account that no voltage is dropped between the inverting and noninverting inputs of an ideal operational amplifier. Equally, no currents flow through the inputs of an ideal operational amplifier. Therefore, there flows through the resistor R1 the same current IC1 that flows through the adjustable resistor R0, and the following holds true:

$$VR1/R1=VR0/R0 \quad (4)$$

If equations (2) and (3) are inserted into equation (4), then the following is obtained:

$$Vref=Vbe2+(R1/R0)*(Vbe2-Vbe1) \quad (5)$$

Comparing equation (5) with equation (1) reveals that the second addend of the right-hand side of equation (5) represents the voltage VR2.

The temperature-dependent collector currents Ic1 and Ic2 of the bipolar transistors T1 and T2, respectively, depend exponentially on the base-emitter voltages Vbe1 and Vbe2, respectively, and on a so-called thermal voltage VT:

$$Icx=Isx*(\exp(Vbex/VT)-1) \text{ where } x=1, 2 \quad (6)$$

In this case, Isx denotes the reverse current of the respective bipolar transistor T1 or T2. The following dependence on the absolute temperature T in kelvins holds true for the thermal voltage VT:

$$VT=k*T/q, \quad (7)$$

where k denotes Boltzmann's constant ($1.38*10^{-23}$ J/K) and q denotes the elementary charge ($1.6*10^{-19}$ C). For Vbex>>k* T/q, transforming equation (6) yields:

$$Vbex=VT*\ln(Icx/Isx) \quad (8)$$

If this equation is applied to the BGR circuit illustrated in FIG. 4 and if:

$$VR1=VR2 \quad (9)$$

holds true, then the following results for equation (3):

$$VR0=Vbe2-Vbe1=VT*\ln(R1/R2) \quad (10)$$

With this equation it has been assumed that the two bipolar transistors T1 and T2 are structurally identical and accordingly have the same reverse current Isx. Equation (10) can then be inserted into equation (5):

$$Vref=Vbe2+(R1/R0)*VT*\ln(R1/R2) \quad (11)$$

As has already been described above, the base-emitter voltage Vbe2 has a temperature coefficient of −2 mV/K. Equation (7) reveals that the thermal voltage VT has a temperature coefficient of +0.086 mV/K. Through a suitable choice of the resistors R0, R1 and R2, the second addend of the right-hand side of equation (11) may be designed such that it has a temperature coefficient of +2 mV/K.

To summarize, the inventive BGR circuit generates two voltages which have temperature coefficients that are opposite but identical in terms of magnitude. Adding these two voltages yields a temperature-stabilized reference voltage. Deviations from the ideal value of the reference voltage and from the ideal temperature response of the reference voltage arise on account of inhomogeneities among the same components which are used for the different BGR circuits from the same production series. The BGR circuit allows such inhomogeneities to be compensated for by voltage adjustments both of the operation amplifier used and of the incorporated resistors.

We claim:

1. A method for adjusting a circuit for generating a temperature-stabilized reference voltage to generate a predetermined value of the reference voltage, the method which comprises:

providing the circuit with a voltage differential amplifier and an external circuitry including at least one component with a variable resistance, the external circuitry being associated with the voltage differential amplifier;

performing an offset adjustment of the voltage differential amplifier at a predetermined temperature; and subsequently adjusting the reference voltage to the predetermined value of the reference voltage at the predetermined temperature by setting the variable resistance of the component.

2. The method according to claim 1, wherein the step of performing the offset adjustment includes:

short-circuiting inputs of the voltage differential amplifier; and regulating an output voltage of the voltage differential amplifier to a predetermined voltage value.

3. The method according to claim 2, wherein the voltage differential amplifier is operated as a comparator when performing the step of regulating the output voltage.

4. The method according to claim 1, wherein the step of adjusting the reference voltage includes:

obtaining a measured reference voltage by measuring the reference voltage of the circuit; and varying the variable resistance of the component until the measured reference voltage equals the predetermined value of the reference voltage.

5. A circuit for generating a temperature-stabilized reference voltage, comprising:

a voltage differential amplifier having an inverting input, a noninverting input, and an output;

a device for offset correction assigned to said voltage differential amplifier; and an external circuitry configured external to said voltage differential amplifier;

said external circuitry connected to said inverting input, said noninverting input, and said output of said voltage differential amplifier;

said external circuitry constructed such that the output voltage of said voltage differential amplifier corresponds to a sum of at least two signals each having a temperature characteristic, the temperature characteristic of one of the two signals having a sign that is different than the temperature characteristic of another one of the two signals;

said external circuitry including at least one component having a variable resistance for influencing the temperature characteristic of at least one of the two signals;

said external circuitry including a first switching device for isolating said inverting input and said noninverting input of said voltage differential amplifier from said external circuitry; and said external circuitry including a second switching device for short-circuiting said inverting input and said noninverting input of said voltage differential amplifier.

6. The circuit according to claim 5, wherein:

said external circuitry includes a first circuit branch and a second circuit branch each connected between a common fixed potential and said output of said voltage differential amplifier;

said first circuit branch includes a node;

said second circuit branch includes a node;

first switching device includes a first switch;

said second switching device includes a second switch;

said inverting input of said voltage differential amplifier is connected to said node of said first circuit branch via said first switch; and said noninverting input of said voltage differential amplifier is connected to said node of said second circuit branch via said second switch.

7. The circuit according to claim 6, wherein the common fixed potential is ground.

8. The circuit according to claim 5, wherein:

said first circuit branch includes a transistor circuit; and said second circuit branch includes a transistor circuit.

9. The circuit according to claim 5, wherein:

said first circuit branch includes a resistor connecting said node of said first circuit branch to said output of said voltage differential amplifier; and said second circuit branch includes a resistor connecting said node of said second circuit branch to said output of said voltage differential amplifier.

10. The circuit according to claim 5, wherein:

said external circuitry includes a first circuit branch and a second circuit branch each connected between the common fixed potential and said output of said voltage differential amplifier;

said first circuit branch includes a first transistor with a collector terminal, a base terminal connected to said collector terminal of said first transistor, and an emitter terminal at a common fixed potential; and said second circuit branch includes a second transistor with a collector terminal, a base terminal connected to said collector terminal of said first transistor, and an emitter terminal at the common fixed potential;

said first circuit branch includes a node;

said second circuit branch includes a node;

said component having said variable resistance connects said node of said first circuit branch to said collector terminal of said first transistor; and said node of said second circuit branch is connected to said collector terminal of said second transistor.

11. The circuit according to claim 5, wherein:

said external circuitry includes two nodes;

said external circuitry includes a first transistor with a collector terminal, a base terminal connected to said collector terminal of said first transistor, and an emitter terminal at a common fixed potential; and said external circuitry includes a second transistor with a collector terminal, a base terminal connected to said collector terminal of said first transistor, and an emitter terminal at the common fixed potential;

said component having said variable resistance connects one of said two nodes to said collector terminal of said first transistor; and another one of said two nodes is connected to said collector terminal of said second transistor.

12. The circuit according to claim 5, further comprising:

a constant voltage source switchably connected to a chosen input selected from a group consisting of said inverting input and said noninverting input of said voltage differential amplifier;

a third switching device for isolating said chosen input of said voltage differential amplifier from said constant voltage source.

13. The circuit according to claim 5, wherein said voltage differential amplifier is an operational amplifier.

14. The circuit according to one claim 5, wherein said device for offset correction is an adjustable trimming resistor.

* * * * *